US010259472B2

(12) United States Patent
Veit

(10) Patent No.: US 10,259,472 B2
(45) Date of Patent: Apr. 16, 2019

(54) STAKE POCKET FOR RAILROAD CAR

(71) Applicant: National Steel Car Limited, Hamilton (CA)

(72) Inventor: Oliver Veit, Hamilton (CA)

(73) Assignee: National Steel Car Limited, Hamilton, Ontario (CA)

( * ) Notice: Subject to any disclaimer, the term of this patent is extended or adjusted under 35 U.S.C. 154(b) by 897 days.

(21) Appl. No.: 14/639,658

(22) Filed: Mar. 5, 2015

(65) Prior Publication Data

US 2016/0257312 A1 Sep. 8, 2016

(51) Int. Cl.
*B61D 3/00* (2006.01)
*B61D 45/00* (2006.01)

(52) U.S. Cl.
CPC ..... *B61D 45/003* (2013.01); *B61D 3/00* (2013.01)

(58) Field of Classification Search
CPC ..... B61D 3/08; B61D 45/003
USPC ..... 105/406.1
See application file for complete search history.

(56) References Cited

U.S. PATENT DOCUMENTS 1,046,305 A 12/1912 Keagy et al.
1,091,546 A 3/1914 Tatum
1,123,144 A 12/1914 Rohlfing
1,123,181 A 12/1914 Donadon et al.
1,124,787 A 1/1915 Murray
1,128,863 A 2/1915 Fowler
1,128,864 A 2/1915 Fowler
1,287,335 A 12/1918 Keagy et al.
1,825,832 A * 10/1931 Tatum ..... B61D 3/08 105/391
1,863,364 A * 6/1932 Anderson ..... B61D 3/08 105/391
2,009,468 A * 7/1935 Anderson ..... B61D 3/08 105/391
2007/0101896 A1* 5/2007 Forbes ..... B61D 17/00 105/406.1
2010/0011987 A1* 1/2010 Forbes ..... B61D 17/08 105/406.1
2016/0257312 A1* 9/2016 Veit ..... B61D 3/00

* cited by examiner

*Primary Examiner* — Jason C Smith
(74) *Attorney, Agent, or Firm* — Hahn Loeser & Parks LLP

(57) ABSTRACT

A railroad gondola car may have stake pockets in which to mount stakes to permit a greater vertical envelope to be occupied by lading. The stake pockets are collapsible from a deployed position to a storage position. The stake pockets are mounted on doublers that mount to the side walls of the car in line with the side wall stiffeners and their associated cross-bearers. The connection between the stake pocket and the doubler is deliberately made weaker than the connection between the doubler and the side wall such that under abusive loading conditions the stake pocket may tend to shear off the doubler, and may tend thereby to leave the side wall less damaged than might otherwise be the case.

18 Claims, 7 Drawing Sheets

STAKE POCKET FOR RAILROAD CAR

FIELD OF THE INVENTION

This invention relates to the field of stake pockets for railroad freight cars.

BACKGROUND

Railroad gondola cars are sometimes used for more than one purpose. In some configurations they may carry lading of one type, and in another configuration they may carry another type. Alternatively, the freight car may be one in which the lading may be relatively low density lading, such that the car may tend to bulk out (i.e., run out of volume within the applicable AAR Plate envelope) before it reaches the maximum Gross Rail Load (GRL).

In such instances the lading carrying volume or body of the car may be provided with extensions, such as posts or poles or "stakes" that stand upwardly of the car body generally, and that function as retainers to discourage lading from moving. An example of such a use is found in gondola cars such as may sometimes be used for carrying lumber, or logs, or pipe.

Earlier examples of stake pockets are shown in U.S. Pat. No. 2,009,468; 1,863,364; 1,825,832; 1,287,335; 1,128,864; 1,128,863; 1,124,787; 1,091,546; 1,123,181; 1,123,144; and 1,046,305.

SUMMARY OF THE INVENTION

In an aspect of the invention there is a stake pocket for a railroad car. The stake pocket assembly has a stake pocket and an intermediate or interface member. The stake pocket being movable between a deployed position and a retracted position. The stake pocket is frangibly mounted to the interface member. The interface member defines a mounting fitting for attachment to a wall member of the railroad freight car.

In a feature of that aspect of the invention, the assembly includes an obliquely angled hinge protector. In another feature, the stake pocket includes a throw member and a hinge retainer. The throw member has an accommodation for receiving a post. The throw member has trunnion ends. The hinge retainer accommodates the trunnion ends of the throw member. In a further feature, the hinge retainer includes an obliquely-sloped upwardly-facing shed plate. In another feature, the stake pocket includes a toggle by which to maintain the stake pocket in a deployed position.

In another feature, there is a railroad gondola car having a lading receptacle bounded by first and second spaced-apart side walls. The gondola car has the stake pocket mounted to at least one of the side walls. In an additional feature the stake pocket is mounted to the interface member at a mechanical fuse. In another feature, the stake pocket is mounted to the interface member at a first connection. The interface member is mounted to the first side wall at a second connection. The second connection is more resistant to separation than is the first connection.

In still another feature, the first side wall includes a side sheet. The interface member includes a base plate mountable to the side sheet. The base plate having a through-thickness greater than the side sheet of the first side wall. In yet another feature, the interface member is a doubler for mounting to the side sheet of the first side wall. In another feature, the interface member is secured to the side sheet of the first side wall by a first length of weldment. The stake pocket is secured to the interface member by a second length of weldment. The second length of weldment is less than the first length of weldment. In still another further feature, the interface member is secured to the side sheet of the first side wall at a first attachment footprint. The first attachment footprint has a first internal area and an area moment of inertia. The stake pocket is secured to the interface member at a second attachment footprint. The second attachment footprint has a second internal area and a second area moment of inertia and (a) the first internal area is greater than the second internal area; and (b) the first area moment of inertia is greater than the second area moment of inertia. In an additional feature, the first and second attachment footprints are defined by weldmetal passes. In still another feature, the stake pocket is mounted to an inside face of the side sheet of the first side wall, and a side sheet stiffener is mounted to an outside face of the side sheet in alignment with the stake pocket.

In another aspect of the invention there is a railroad freight car assembly. It has a side wall of the freight car, an intermediate member, and a stake pocket. The intermediate member is mounted to the side wall. The stake pocket is mounted to the intermediate member.

In a feature of that aspect, the stake pocket is less well secured to the intermediate member than is the intermediate member to the side sheet. In another feature, the intermediate member is a doubler. In still another feature, the stake pocket is frangibly mounted to the intermediate member. In yet another feature the stake pocket is mounted to the side wall at the same longitudinal station as a stiffener of the side wall. In a further feature, the stiffener of the side wall has a moment connection to a cross-bearer of the freight car at that same longitudinal station. In still another feature, the stake pocket is movable between a first position in which to receive a stake, and a second position for storage. In still yet another further feature the stake pocket is a first stake pocket. There is a second stake pocket at the same longitudinal station. The first stake pocket is an upper stake pocket and the second stake pocket is a lower stake pocket. Both of the first and second stake pockets are movable between a first position in which to receive a stake, and a second position for storage.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1:
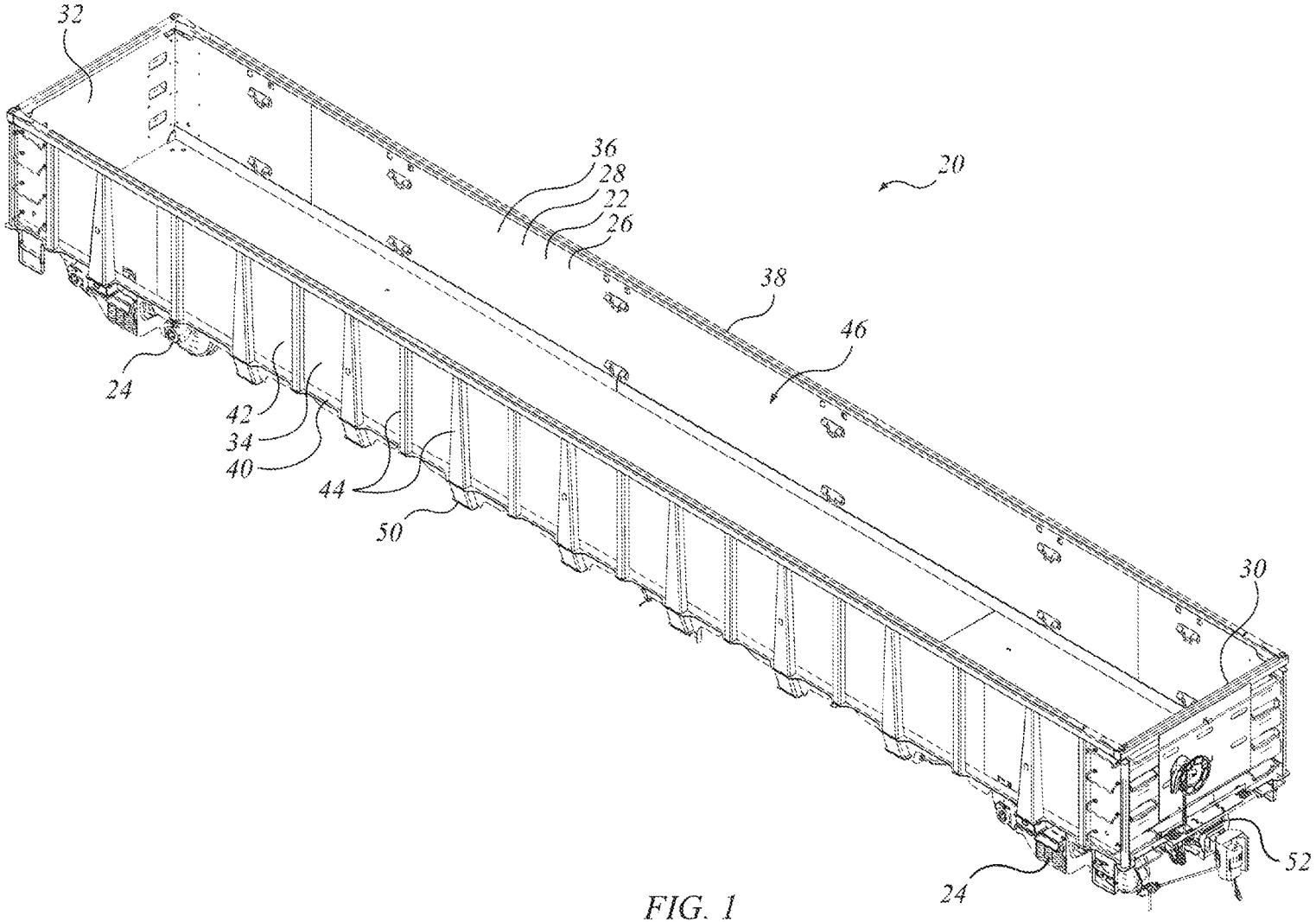
FIG. 1 is a general arrangement, isometric view of a railroad freight car.
Figure 2:
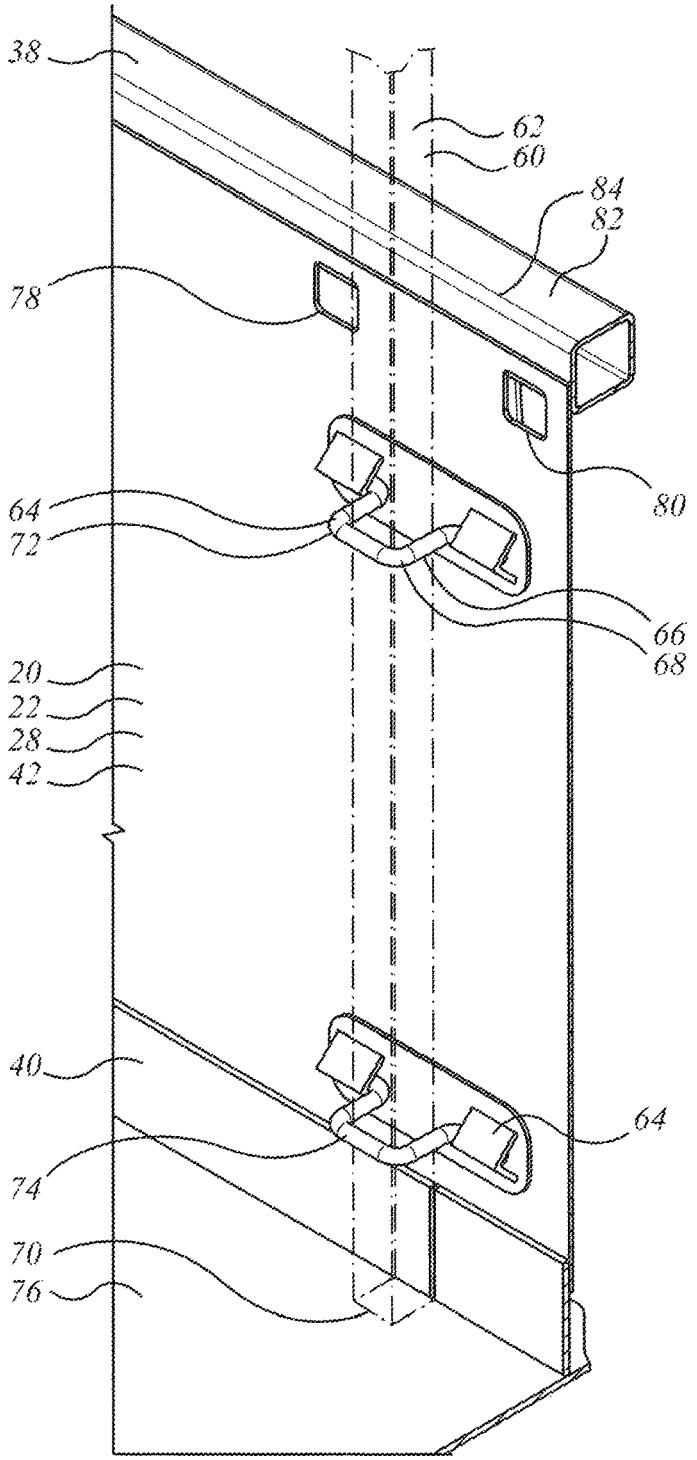
FIG. 2 is an isometric view of an enlarged detail of the railroad freight car of FIG. 1 showing a stake pocket and a retainer post mounted therein.

The description that follows, and the embodiments described therein, are provided by way of illustration of an example, or examples, of particular embodiments of the principles, aspects, or features of the present invention (or inventions, as may be). These examples are provided for the purposes of explanation, and not of limitation, of those principles and of the invention. In the specification, like parts are marked throughout the descriptive text and the drawings with the same respective reference numerals. The drawings are generally to scale, and may be taken as being to scale unless otherwise noted. Unless noted otherwise, the structural members of the car may be taken as being fabricated from steel, most typically mild steel of 50 kpsi or ksi (thousands of pounds per square inch) yield strength. The structure may be of welded construction, most typically, but may alternatively include mechanical fasteners such as Huck™ bolts, rivets, and so on. The structure need not be entirely, or even partially, mild steel, but could include other grades of steel in particular locations, such as the discharge sections, may include consumable wear plates, or plates of greater hardness and wear resistance. In some instances, some or all portions of the primary structure may be made of stainless steel, aluminum, or engineered plastics and composites. Nonetheless, most commonly welded mild steel construction may be assumed as the default condition.

The terminology used in this specification is thought to be consistent with the customary and ordinary meanings of those terms as they would be understood by a person of ordinary skill in the railroad industry in North America. Following from decision of the CAFC in *Phillips v. AWH Corp.*, the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with *In re Lee*, (for example, earlier publications by persons not employed by the USPTO or any other Patent Office), demonstrating how the terms are used and understood by persons of ordinary skill in the art, or by way of expert evidence of a person or persons of at least 10 years experience in the railroad industry in North America or in other territories or former territories of the British Empire and Commonwealth.

In terms of general orientation and directional nomenclature, for railroad cars described herein the longitudinal direction is defined as being coincident with the rolling direction of the railroad car, or railroad car unit, when located on tangent (that is, straight) track. In the case of a railroad car having a center sill, the longitudinal direction is parallel to the center sill, and parallel to the top chords. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the railroad car described herein may tend to have both longitudinal and transverse axes of symmetry, a description of one half of the car may generally also be intended to describe the other half as well, allowing for differences between right hand and left hand parts. In this description, the abbreviation kpsi stands for thousand of pounds per square inch. To the extent that this specification or the accompanying illustrations may refer to standards of the Association of American Railroads (AAR), such as to AAR plate sizes, those references are to be understood as at the earliest date of priority to which this application is entitled.

FIG. 1 shows an isometric view of an example of a railroad freight car 20 that is intended to be representative of a wide range of railroad cars in which the present invention may be incorporated. While car 20 may be suitable for a variety of general purpose uses, it may be taken as being symbolic of, and in some ways a generic example of, a gondola car. In the example, gondola car 20 may have many different uses. One of those uses may be for carrying bundles of wood products. Another use may be for transporting logs. Another use may be for transporting pipe, carrying steel slab or scrap steel, and so on. Car 20 may be symmetrical about both its longitudinal and transverse, or lateral, centerline axes. Consequently, it will be understood that the car has first and second, left and right hand side beams, bolsters and so on. The car may be uncovered during rain or snowfall.

By way of a general overview, car 20 may have a car body 22 that is carried on trucks 24 for rolling operation along railroad tracks. Car 20 may be a single unit car, or it may be a multi-unit car having two or more car body units, where the multiple car body units may be connected at an articulated connector, or by draw bars. Car body 22 may have a lading containment vessel or shell 26 such as may include an upstanding wall structure 28 which may have a pair of opposed first and second end walls 30, 32, that extend cross-wise, and a pair of first and second side walls 34, 36 that extend lengthwise, the end walls 30, 32 and side walls 34, 36 co-operating to define a generally rectangular form of peripheral wall structure 28. Wall structure 28 may include top chords 38 running along the top of the walls, and side sills 40 running fore-and-aft along lower portions of the side sheets 42 of side walls 34, 36. As a point of clarification, gondola cars conventionally have side sills in the form of a monolithic, longitudinally formed section, quite typically a large angle iron. However, other cars do not have side sills, as such, but rather rely upon the co-operation of a lower portion of the side sheet of the side wall to act as a vertical web, and on the floor sheet to act as the side sill flange, and thus as the lower flange of the side beam. Although these later cars do not have a sill, per se, the side sill function is still performed by the joined members, and, for the purposes of this discussion they can be thought of as being the "side sill".

On each side wall of the car, the side sheet 42 extends between side sill 40 and top chord 38. The side wall structure forms a deep beam in which the top chord defines the top flange, the side sill defines the bottom flange, and the side sheet defines a shear web. Car 20 may also have internal or external side wall sheet stiffeners 44 such as may be spaced along the side walls of the car, and such as may tend to prevent local buckling of the side sheets. A gondola car typically has the wall stiffeners mounted externally, i.e., on the outside face of the side wall sheet or web 42. The various top chords 38 on the side walls and end walls may cooperably define an opening, generally indicated as 46, through which lading may be introduced into the containment vessel.

Car 20 may also have an underframe structure, indicated generally as 50. Underframe structure 50 may include a center sill 52, be it a stub center sill or a straight-thorough center sill; and cross-members 48, such as may be cross-bearers 54. Where there is a straight through center sill, the cross-bearers 54 may have the form of cantilevered arms extending laterally from moment connections at which they mate with the center sill. Whether there is or is not a center sill, the cross-bearers may have moment connections, such as structural knees 58 at the junction at the side sills with the side sheet stiffeners. Where there is such a moment connection the side sheet stiffeners and cross-bearers may act as springs tending to discourage lateral deflection of the top chord, e.g., such as may tend to occur in buckling under longitudinal compressive loading of the structure.

In some instances car 20 may have stub center sills at either end, in which case side walls 34, 36 may act as deep beams, and may carry vertical loads to main bolsters that extend laterally from the centerplates. Alternatively, or in addition to deep side beams, car 20 may include a center sill 52, which may be a straight-through center sill, running from one end of the car body to the other. In the case of a single, stand alone car unit, draft gear and releaseable couplers may be mounted at either end of the center sill.

Car 20 may be a gondola car suitable for carrying bundles of lumber, logs, steel slabs, scrap steel, or pipe. Those types of lading may be relatively low density forms of lading. It may be that the volume of the gondola body of car 20 below the top of top chords 38 is not such that, even if filled, the car may reach the permitted GRL, and the center of gravity of the car may still be well below the 98" limit above Top of Rail. Car 20 may then have a set of upwardly standing auxiliary retainers, indicated generally as 60. Those retainers may have the form of posts or pillars, or stakes, 62.

The "stakes" 62 are auxiliary posts, or post extensions, that are positioned in spaced relationship along the side walls of the car body. The stakes may be mounted inside the side wall. The stakes are themselves retained by, or may seat in, holders or fittings such as may be identified as stake pocket assemblies, or stake pockets, 64. Each stake pocket 64 may tend to have the form of, or may tend to include, a receiving member in the form of a shaped steel fitting, be it a metal hanger, or cleat or bracket 66. It may tend to have a channel or top-hat shaped loop of metal, such as a bent iron bar, of which the three-sided bent portion forms an eye or keeper, or socket 68. The post, or stake, 62, is then passed through the eye. There may typically be two pockets 64 at each given stake location, there being an upper pocket 72 near the top chord, and a lower pocket 74 near the floor of the car. The stake pockets may tend to line up with the external vertical stiffeners 44. That is, stiffener 44 is mounted to the outside of the web of the side sheet, and the stake pockets are mounted to the inside of the web of the side sheet, at the same location. To the extent that the side sheet stiffener has a moment connection 58 at the side sill (e.g., to the cross-bearer at the same longitudinal station of the car body) and is therefore a cantilever, the stake may be considered an extension of that stiffener or cantilever. Since the stake is retained at top and bottom it has a single degree of freedom—namely vertical translation to thread the eyes of stake pockets 72 and 74 during installation or removal.

The bottom or foot 70 of the post or stake 62 may seat on the bottom of the gondola body, as a floor sheet, or floor 76. In some embodiments the vertical reaction may be provided by a base fitting or abutment such as an angle bracket mounted inside the gondola side sheet with a flange thereof extending inwardly of the wall to form a shelf or footing for the post. Alternatively, the base of the post or stake 62 may rest directly on the floor of the gondola, as shown. The location of the post fitting on the floor may be positioned directly above a cross-member, whether that cross-member is the main bolster, a cross-bearer, or a cross-tie. In alternate embodiments, the lower fitting, stake pocket 74, may be omitted, and a footing substituted in its place. The footing may have the form of an upwardly facing socket fitting, similar to the step of a mast, or it may by a socket formed in the floor sheet itself, such that the bottom of the stake may seat and be discouraged from displacement in the longitudinal (i.e., x-axis) or lateral (i.e. y-axis) direction. A floor socket may also have a drain.

In some embodiments, there may be openings, or holes, or eyes, or apertures 78, 80 formed in the gondola car side wall near (i.e., just below) top chord 38. In the embodiment shown, a pair of such apertures 78, 80 brackets each stiffener 44, and, equivalently, brackets each stake 62, when installed. Apertures 78, 80 are provided to permit the passage of banding therethrough for cinching lading such that the lading may tend to be secured in a fixed position in the gondola body and against the stakes, as may be, prior to movement of the railroad car.

Figure 3A:
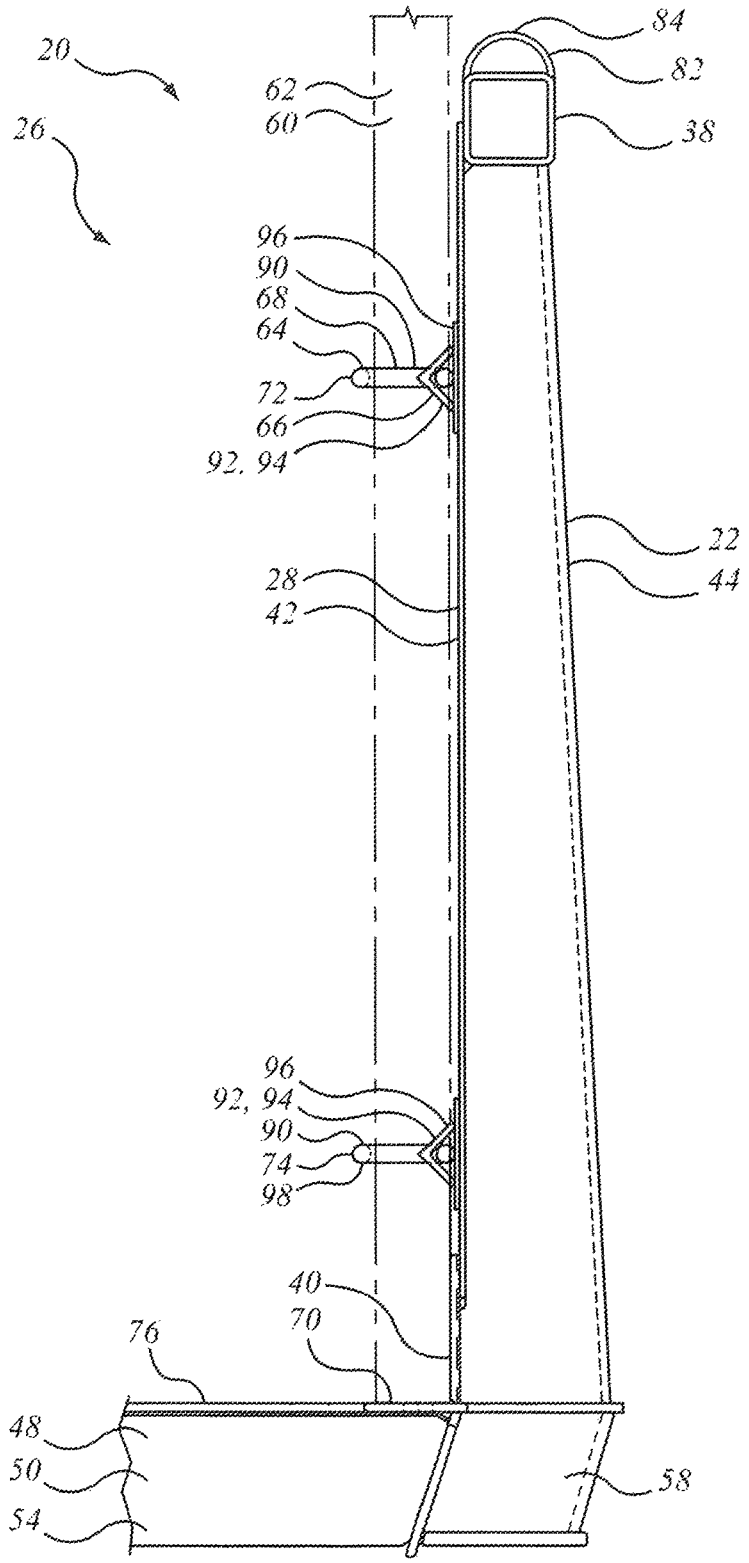
FIG. 3*a* is a side view of the detail of FIG. 2 taken on a cross-section of a side wall of the railroad freight car of FIG. 1 at a cross-bearer.
Figure 3B:
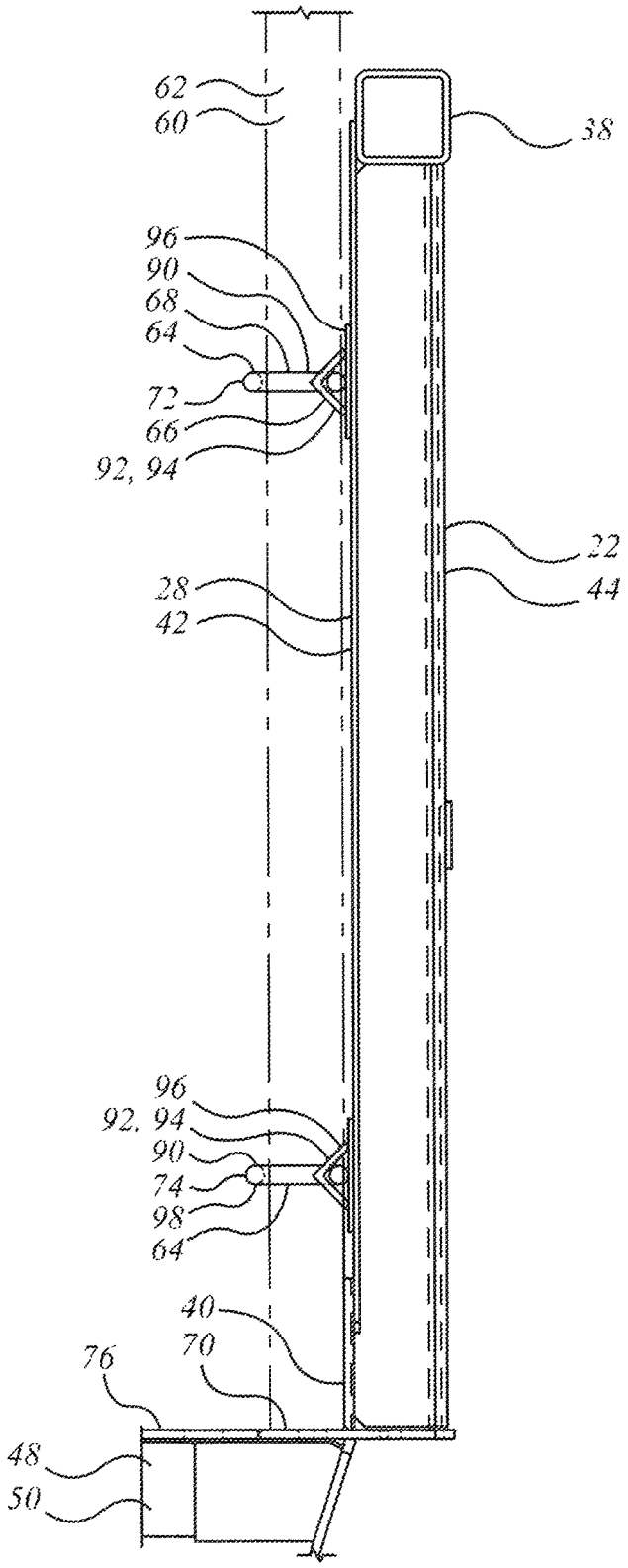
FIG. 3*b* is a side view as in FIG. 3*a*, but at a cross-tie.

Top chords 38 may have a cross-section as shown in FIG. 3*a*, for example, in which the upper surface 82 presents a rounded profile 84. The rounded profile 84 may tend to shed lading, rather than to facilitate the accumulation of lading thereupon. The rounded profile is continuous along the car from end to end. The rounded profile is free of cut-outs at the location of apertures 78, 80. That is, at the location of apertures 78, 80, the top chord presents a rounded, smoothly radiused profile against which the banding may bear, that profile being free of sharp edges such as might otherwise cut or fray the banding.

Figure 4B:
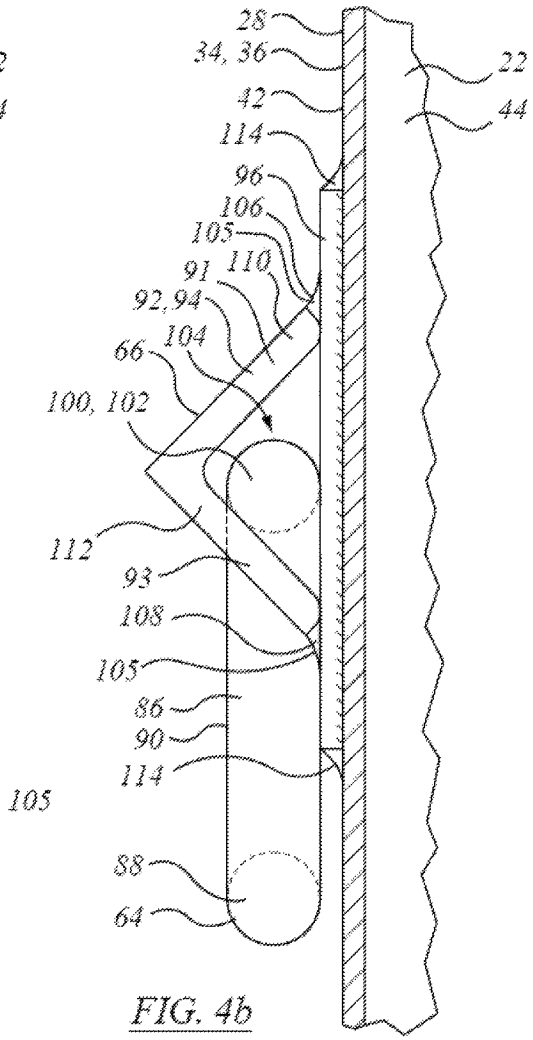
FIG. 4*b* is the same view as FIG. 4*a*, but showing the stake pocket in a non-deployed position or condition.
Figure 4A:
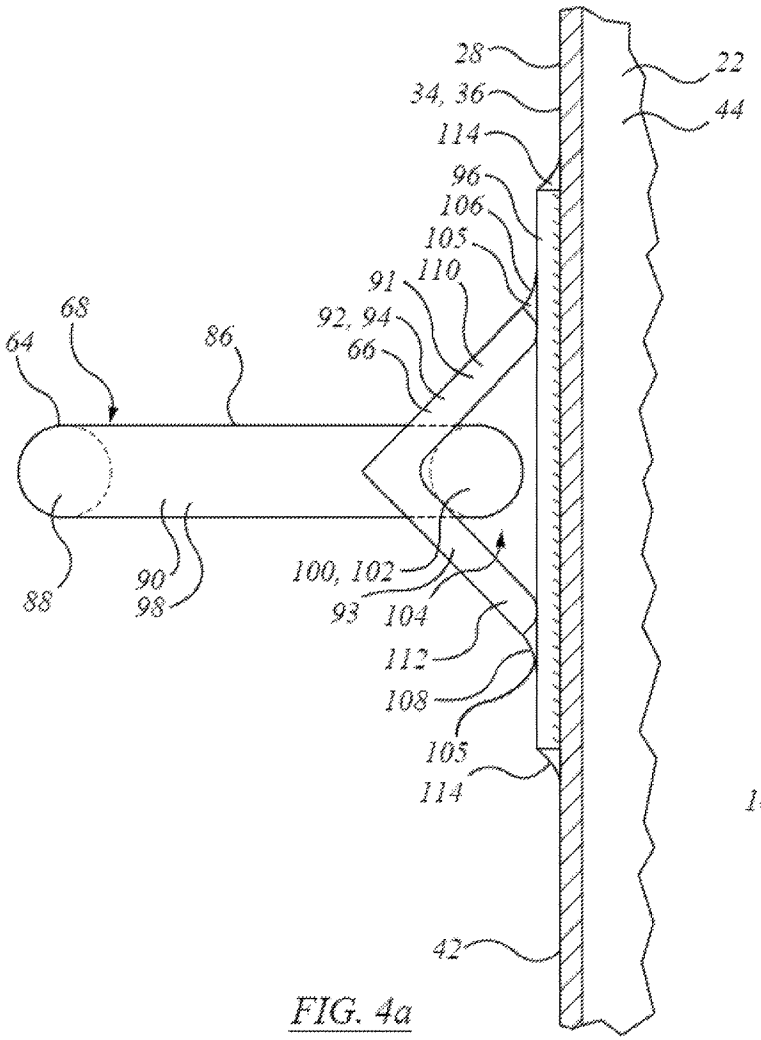
FIG. 4*a* is an enlarged detail of the sectional view of FIG. 3 showing a stake pocket in deployed position or condition.
Figure 5A:
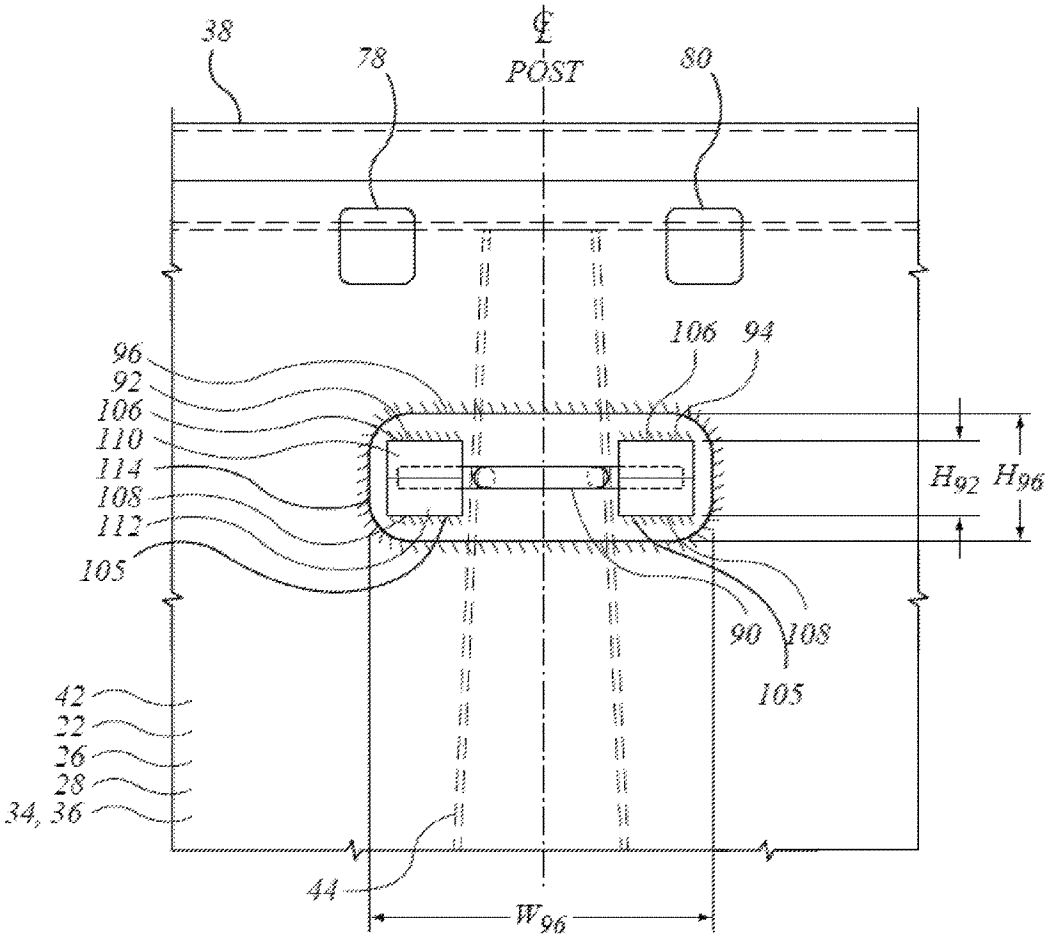
FIG. 5*a* is a front view of the enlarged detail of FIG. 4*a;*
Figure 5B:
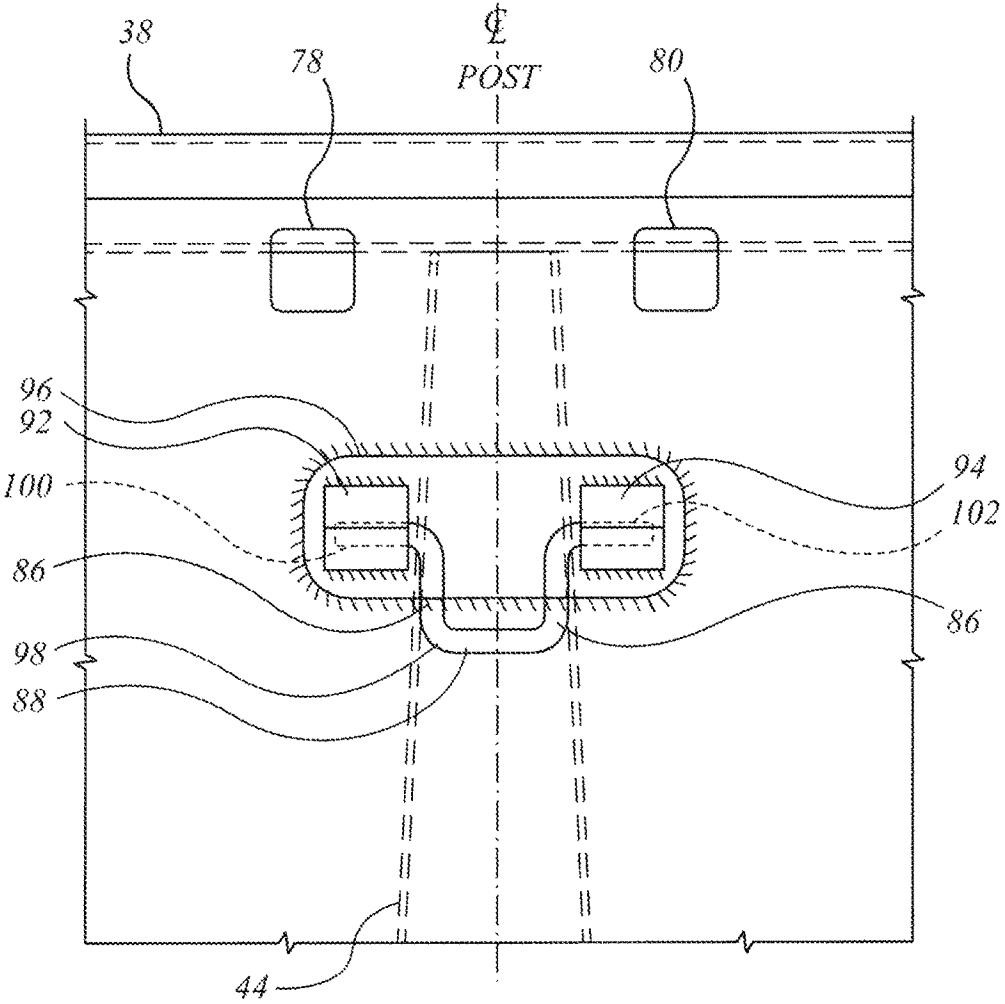
FIG. 5*b* is a front view of the enlarge detail of FIG. 4*b;*

Looking now at the stake pockets themselves, each stake pocket, or stake pocket 64 may be an assembly that includes a first or movable member 90; a second or stationary member or members 92, 94; and a third, or intermediate, or interface, or seat member 96. Third member 96 may have the form of a sole plate, or footing, or doubler. The movable member may have the form of a bar formed to have a U-shaped throw 98, and two opposed stub-axle or trunnion ends 100, 102. The U-shaped throw has arms 86 and a reach 88 corresponding to the size of the depth (in the cross-wise direction of the car perpendicular to the side wall) and width (lengthwise direction of the car, parallel to the side wall) of stake 62. Stationary member, or stationary members, 92, 94 may be the retainers, or stationary hinges, or hinge portions into which trunnion ends 100, 102 seat. That is, on assembly the retainers, members 92, are secured to the intermediate member, 94, and, when so secured, capture trunnion ends 100, 102 in the space between member 92 and member 94. The lateral spacing between members 92 corresponds to (i.e., is slightly greater than) the outside overall width of U-shaped throw 96, which itself is dimensioned to receive (i.e., is slightly greater than) the width of stakes 64. In the example illustrated members 92, 94 may be cut sections of angle iron welded toes-in against the doubler, member 96, such that a generally triangular accommodation 104 is formed, into which the respective ones of trunnion ends 100, 102 seat. In FIGS. 4*a* and 4*b*, the angle iron has a first leg 91, being the upper leg, and a second leg 93, being the lower leg. Triangular accommodation 104 has a vertical wall defined by member 96, and angled walls defined by legs 91 and 93. First and second legs 91 and 93 lie at oblique angles, as shown. First leg 91 defines an obliquely angled hinge protector, namely an obliquely angled upwardly facing plate. As so captured, the member 90 is movable from a first position, such as the deployed position shown in FIG. 4*a* to a second, or storage, or non-deployed position, as shown in FIG. 4*b*.

As noted, the retainers, members 92, 94, are secured to the intermediate member. This securement may be by mechanical fasteners, such as bolts, or Huck™ bolts, or rivets, or may be achieved by other means of adhesion or securement. In particular it may be achieved by a thermal fusion or melting process, such as may include welding. Members 92, 94 may be welded to member 96 at fillets 106, 108 along their respective upper and lower toes 110, 112. The length of the fillet may correspond to the length of the toe, and is a known distance.

The intermediate or interface member, 96, is likewise secured to the car side wall. As with the retainer members, the securement may be by a variety of means, whether by mechanical fasteners, such as bolts, or Huck™ bolts, or rivets, or by other means of adhesion or securement. In particular it may be achieved by a fusing or melting process, such as by welding.

Member 96 may have a generally square or rectangular shape with generously rounded corners, or a somewhat oval shape, as may be. It may have a height $h_{96}$ and a width $w_{96}$. The height, $h_{96}$, is greater than the span extent $h_{92}$ of members 92, 94 in the height direction, and may typically be more than half as much again as that span distance $h_{92}$, i.e., $h_{96}>3/2\ h_2$. Similarly, width $w_{96}$ is greater than the overall width $w_{92}$ of members 92, 94 as mounted.

Stake pocket 64 may be centered on member 96. That is, the periphery of the footprint of stake pocket 64 on intermediate member 96 may fall entirely within the periphery of member 96. Expressed differently, relative to the centroid of member 96, which is taken also as being the centroid of the mounting footprint of stake pocket 64, the most distant extremities of stake pocket 64 lie at shorter moment arm distances from the centroid than do the corresponding extremities of member 96. The length of the footprint contacts, or weldments, of stake pocket 64, being the sum of the lengths of the toes bearing against member 96, is less than the arc length of the periphery of member 96.

Member 96 (and hence stake pocket 64) may be centered on the side sheet stiffener 44. In this position, member 96 may straddle, or bracket, or overlap the width, $w_{44}$ of stiffener 44 to both sides. The overlap on a centered (i.e., symmetric) positioning will be equal on both sides of the post by definition. Member 96 may be the same thickness as, or may be thicker or thinner than, side sheet 42.

Whether by mechanical fasteners or by welding, attachment of stake pocket 64 to intermediate member 96 is a by first connection identified as a mechanical fuse 105 that has a strength that is weaker than the strength of a second connection namely the attachment of intermediate member 96 to side wall 34 or 36, such as may be. In particular, the shear strength of the attachment under an applied force parallel to the face of the side wall surface is less than that of member 96 to the side wall 34, 36, as also may be the tensile strength of the attachment in a direction perpendicular to the inside face of the side wall. Further, in torsion, the length of the peripheral weld 114 of the second connection, namely of member 96 to the car sidewall 34, 36 is both greater in total and at a larger moment arm distance from the centroid than is, or are, the total weldment length and corresponding moment arm distances of the welds of weld fillets 106, 108 of the first connection of fuse 105 of members 92 and 94 to member 96, such that in a torsional twisting or tearing motion members 92, 94 may tend to be torn from member 96 more easily than member 96 may be torn from the side wall 34, 36. Expressed differently again, a first peripheral boundary may be defined circumscribing the footprint of attachment of member 96 to the side wall. A second peripheral boundary may be defined that circumscribes the mounting footprint of members 92, 94 on member 96. The first attachment footprint has a first internal area and an area moment of inertia. The second attachment footprint has a second internal area and a second area moment of inertia and (a) the first internal area is greater than the second internal area; and (b) the first area moment of inertia is greater than the second area moment of inertia.

Member 96 as shown and described is mounted on the inside face of side sheet 42, and functions both as the interface member to which members 90, 92 and 94 are mounted on assembly, and as a local doubler to resist tearing of side sheet 42. In alternate embodiments, another doubler, which may have a footprint similar to member 96, may also be mounted to the outboard face of side sheet 42, so that the mounting is reinforced both inside and outside. Such an embodiment may require that the toes of the associated side wall stiffener be locally relieved or notched to accommodate the thickness of the external doubler.

When the stake pocket is not in use, it may move to a storage position lying flat against the inside wall of the car. The stake pocket may then define a nodal point at which the freedom of motion of the upstanding post is restrained in the x-direction (i.e., along the car) and in the y-direction (i.e., across the car). Where two such stake pockets are placed in alignment one above the other, the post will be retained in an upright orientation, and will have only the single, vertical, up-and-down translational degree of freedom that permits insertion and extraction of the stake, as may be.

The collapsible stake pockets may have a receiving member that rotates and a stationary member that is attached to the side of the car. The receiving member, when extended to a deployed position generally perpendicular to the side of the car, may then accept the stake and may hold or retain it in position. When not needed, the receiving member is collapsed, or pivoted, or folded, downward, to the side of the car to reduce the likelihood of damage during loading and unloading of product. In the design shown and described herein, the stationary part of the hinge attached to an intermediate member, or interface member, such as a doubler or a backing plate, which may be of various size and shape, as opposed to being attached directly to the side of the car. This backing plate is then fixed to the side of the car, whether by welding, bolting, Huck™) bolting, rivets, or so on.

Due to their location, stake pockets may be prone to damage when loading and unloading cars. They are mounted on the interior surface of the sides of gondola cars where product going into or out of the car may catch on the device and tear it away from the car.

Existing designs have the stationary part of the hinge attached directly to the side sheet of the cars. This design leaves potential for the car body to be damaged if the stake pocket is torn off. Cracks may propagate into surrounding structure and may necessitate extensive repairs.

The design shown and described herein has the stationary part of the hinge attached to the backing plate. This backing plate is the fixed to the side of the car. By design, the connection between the hinge and the backing plate is deliberately made weaker than the connection between the backing plate and the side sheet. In the event that the stake pocket is torn off the car, the damage may then tend to be to the backing plate, as opposed to the car structure. This design is favourable as it decreases the probability of the car needing to be removed from service for structural repairs. This may tend to decrease the frequency of cars being removed from service for structural repairs.

As seen in the drawings, there is a stake pocket assembly for a railroad freight car 20. It has a stake pocket 64 and an interface member 96. Stake pocket 64 is movable between a deployed position (FIG. 4*a*) and a stored position (FIG. 4*b*). Stake pocket 64 is frangibly mounted to interface member 96. Interface member 96 defines a mounting fitting for attachment to a wall member 28 of railroad freight car 20. The stake pocket assembly has an obliquely angled hinge protector, angle iron leg 91, which defines an upwardly facing plate (FIGS. 4*a* and 4*b*). The stake pocket assembly includes a throw member, 98, and a hinge retainer 92, 94. Throw member 98 has an accommodation for receiving a post 62. Throw member 98 has trunnion ends 100, 102. Hinge retainers 92, 94 accommodate trunnion ends 100, 102.

As also seen in the drawings, there is a railroad gondola car 20. It has a lading receptacle or containment vessel 26. It is bounded by first and second spaced-apart side walls 34, 36. Gondola car 20 has the stake pocket assembly mounted to at least one of side walls 34, 36. Stake pocket 64 is mounted to interface member 96 at a mechanical fuse 105 (weld fillets 106, 108). Expressed differently, stake pocket 64 is mounted to interface member 96 at a first connection 65, (the mechanical fuse 105 of weld fillets 106, 108). Interface member 96 is mounted to first side wall 34 at a second connection (weld fillet 114). The second connection is more resistant to separation than is the first connection. First side wall 34 includes a side sheet 42. Interface member 96 includes a base plate 97 mountable to side sheet 42. That is, interface member 96 is a doubler for mounting to side sheet 42 of said first side wall 34. Interface member 96 is secured to side sheet 42 of first side wall 34 by a first length of weldment fillet 114. Stake pocket 64 is secured to interface member 96 by a second length of weldment 106, 108. The second length of weldment is less than said first length of weldment. Expressed differently, interface member 96 is secured to side sheet 42 of first side wall 34 at a first attachment footprint (of peripheral weld 114), the first attachment footprint having a first internal area and an area moment of inertia. Stake pocket 64 is secured to interface member 96 at a second attachment footprint (of weld fillets 106, 108 of members 92, 94). The first and second attachment footprints are defined by weldmetal passes, (peripheral weld 114 and weld fillets 106, 108, respectively). Stake pocket 64 is mounted to an inside face of side sheet 42 of first side wall 34, and a side sheet stiffener is mounted to an outside face of said side sheet in alignment with stake pocket 64.

Various embodiments have been described in detail. Since changes in and or additions to the above-described examples may be made without departing from the nature, spirit or scope of the invention, the invention is not to be limited to those details.

I claim:

1. A stake pocket assembly for a railroad freight car, said stake pocket assembly comprising:

a stake pocket and an interface member;

said stake pocket being movable between a deployed position and a stored position;

said stake pocket being frangibly mounted to said interface member; and said interface member defining a mounting fitting for attachment to a wall member of the railroad freight car;

said stake pocket includes a U-shaped throw having trunnion ends, and first and second hinge retainers;

said interface member is a doubler plate;

said first and second hinge retainers are made of angle iron mounted toes-in to said doubler plate, said respective trunnion ends being trapped by said first and second hinge retainers;

said stake pocket being mounted to said doubler plate at a first connection;

said first connection being defined by weldments at which said angle irons are welded to said doubler plate;

said doubler plate being mounted to a side sheet of the wall member of the railroad freight car at a second connection, said second connection being a welded connection; and said first connection being weaker than said second connection.

2. The stake pocket assembly of claim 1 wherein said assembly includes an obliquely angled hinge protector.

3. The stake pocket assembly of claim 1 wherein said U-shaped throw having an accommodation in which to receive a post.

4. The stake pocket assembly of claim 3 wherein said hinge retainer includes an obliquely-sloped upwardly-facing plate.

5. A railroad gondola car comprising a lading receptacle bounded by first and second spaced-apart side walls, said gondola car having the stake pocket assembly of claim 1 mounted to at least one of said side walls.

6. The railroad gondola car of claim 5 wherein said stake pocket is mounted to said interface member at a mechanical fuse defined by said first connection.

7. The railroad gondola car of claim 5 wherein said side sheet has first and second openings formed through said side sheet to either side of said stake pocket.

8. The railroad gondola car of claim 5 wherein said interface member is secured to a side sheet of said first side wall by a first length of weldment defining said second welded connection; said stake pocket is secured to said interface member by a second length of weldment defining said first welded connection; and said second length of weldment is less than said first length of weldment.

9. The railroad gondola car of claim 5 wherein said interface member is secured to said side sheet of said first side wall at a first attachment footprint, said first attachment footprint having a first internal area and an area moment of inertia; said stake pocket is secured to said interface member at a second attachment footprint, said second attachment footprint having a second internal area and a second area moment of inertia; and (a) said first internal area is greater than said second internal area; and (b) said first area moment of inertia is greater than said second area moment of inertia.

10. The railroad gondola car of claim 9 wherein said first and second attachment footprints are defined by weldmetal passes.

11. The railroad gondola car of claim 5 wherein said stake pocket is mounted to an inside face of a side sheet of said first side wall, and a side sheet stiffener is mounted to an outside face of said side sheet in alignment with said stake pocket.

12. A railroad freight car assembly comprising the stake pocket assembly of claim 1.

13. The railroad freight car assembly of claim 12 wherein:

said assembly includes a railroad freight car sidewall, said sidewall including said side sheet;

said assembly includes a stiffener of the sidewall, said stiffener being located at a longitudinal station of the railroad freight car; and said stake pocket is mounted to said side wall at the same longitudinal station as said stiffener of said side wall.

14. The railroad freight car assembly of claim 13 wherein:

said assembly includes a cross-bearer of the railroad freight car; and said stiffener of said side wall has a moment connection to said cross-bearer of said freight car at that same longitudinal station.

15. The railroad freight car assembly of claim 12 wherein:

said stake pocket is a first stake pocket;

there is a second stake pocket at the same longitudinal station; and said first stake pocket being an upper stake pocket and said second stake pocket being a lower stake pocket;

both of said first and second stake pockets are movable between a respective first position in which to receive a stake, and a respective second position for storage.

16. The railroad freight car assembly of claim 12 wherein:

said railroad freight car assembly includes a side wall of the railroad freight car;

said side wall has a stiffener located at a first longitudinal station of the railroad freight car;

said stake pocket is a first stake pocket;

there is a second stake pocket;

said first stake pocket being an upper stake pocket and said second stake pocket being a lower stake pocket;

both of said first and second stake pockets are movable between a respective first position in which to receive a stake, and a respective second storage position;

said first and second stake pockets are mounted to a respective one of said doublers, said respective doublers being mounted to said side wall at the same longitudinal station as said stiffener of said side wall;

said stiffener of said side wall has a moment connection to a cross-bearer of said freight car.

17. The railroad freight car assembly of claim 12 wherein:

said railroad freight car assembly includes a side wall of the railroad freight car;

said side wall has a top chord and said side sheet, said side sheet extending downwardly of said top chord;

said assembly includes a cross-bearer of the railroad freight car;

said side wall has a stiffener located at a first longitudinal station of the railroad freight car, said sidewall stiffener extending between said cross-bearer and said top chord, said sidewall stiffener having a moment connection to said cross-bearer;

said stake pocket is a first stake pocket, there being there is a second stake pocket at the same longitudinal station, said first stake pocket being an upper stake pocket and said second stake pocket being a lower stake pocket;

both of said first and second stake pockets are movable between a respective first position in which to receive a stake, and a respective second storage position; and said first and second stake pockets are mounted to a respective one of said intermediate members, said respective intermediate members being mounted to said side wall at the same longitudinal station as said stiffener of said side wall.

18. The railroad freight car assembly of claim 17 wherein said side sheet has first and second openings formed through said side sheet beneath said top chord to either side of said stiffener.

* * * * *